United States Patent [19]

Gruner et al.

[11] 4,124,515

[45] Nov. 7, 1978

[54] CASTING POWDER

[75] Inventors: Hans Gruner, Duisburg-Rahm; Hans Schrewe, Duisburg-Ungelsheim; Erich Keuper, Düsseldorf; Fritz-Peter Pleschhutschnigg, Angermund, all of Fed. Rep. of Germany

[73] Assignee: Mannesmann Aktiengesellschaft, Dusseldorf, Fed. Rep. of Germany

[21] Appl. No.: 511,786

[22] Filed: Oct. 3, 1974

[30] Foreign Application Priority Data

Oct. 3, 1973 [DE] Fed. Rep. of Germany ..... 2350244

[51] Int. Cl.[2] ..... B22D 11/10; B28B 7/36

[52] U.S. Cl. ..... 252/62; 106/38.27; 106/38.9; 252/182; 252/350

[58] Field of Search ..... 252/62, 182, 350; 106/38.27, 38.3, 38.9

[56] References Cited

U.S. PATENT DOCUMENTS

| | | | |
|---|---|---|---|
| 1,725,039 | 8/1929 | Williams | 106/38.27 |
| 1,895,639 | 1/1933 | Mond | 106/38.27 X |
| 3,254,380 | 6/1966 | Belcher | 106/38.27 X |
| 3,870,529 | 3/1975 | Okumoto et al. | 106/38.9 X |
| 3,874,885 | 4/1975 | Lyas et al. | 106/38.9 X |
| 3,937,269 | 2/1976 | Salvadore et al. | 106/38.27 X |
| 3,953,219 | 4/1976 | Takashima | 106/38.27 |

*Primary Examiner*—Harold Ansher

*Attorney, Agent, or Firm*—Smyth, Pavitt, Siegemund, Jones & Martella

[57] ABSTRACT

A casting powder for steel having, for example, ground blast furnace slag, and/or sand and caustic lime $CaF_2$ as basic substances with further additives which include up to 10% of additives decomposing completely at temperatures below 600° C under development of gas whereby the mole-volume of developed gas per mole-weight gas-generating additive ($m^3$/Kg) is not smaller than 0.5. Ammonium nitrite or ammonium carbonate is preferred whereby the gaseous decomposition products will be nitrogen, water vapor and/or carbon dioxide.

10 Claims, No Drawings

CASTING POWDER

BACKGROUND OF THE INVENTION

The present invention relates to the use of casting powder for casting of steel, particularly for continuous casting, and more particularly the invention relates to improvements in such powder having practically no combined carbon.

Casting powder when used in casting has basically two purposes; first, premature solidification of the liquidous surface of the molten steel has to be prevented; second, the molten steel is protected by a layer of that powder against combining with oxygen of the surrounding air. Both objects are served by covering the otherwise free and open surface of the molten steel with a layer of material which originally has been applied as powder and remains to some extent in the powderous state but converts to some extent into a molten slag phase. Actually, it is conceivable that very little slag is formed or that practically all of the powder is converted to slag.

It follows that the layer formed by application of powder impedes or even prevents penetration of oxygen into the bath, and it impedes also radiation outflow that may cool the steel too rapidly. Clearly, the smaller the amount of outward radiation from the layer, the smaller will be the loss in thermal energy of the molten steel. For this purpose one uses casting powder — they are commercially available — with carbon in various states. Specifically, the carbon will be heated by the molten steel and combines with oxygen in the ambient air and which has penetrated into the powder. That effect, taken in conjunction with the formation of slag, impedes penetration of oxygen through the covering layer down to the steel underneath.

Casting powders, previously proposed to have no combined carbon, are not useable because they emit too much heat by radiation and serve, thus, insufficiently as heat shield. One could increase the amount of powder used, but it was found that control of the steel level in the mold, particularly for continuous casting becomes increasingly difficult or even impossible under conditions of an excessively thick cover on the level of steel.

Going back now to casting powder containing carbon, tests have established that some of the carbon penetrates into the steel so that the carbon content thereof is locally enriched. That in turn reduces the quality of the steel generally and results in local carbonization of the casting texture.

Another disadvantage of casting powder containing carbon is to be seen in its rather high reaction temperature. Consequently, carbon which has not reacted and powder particles which have not been molten run down along the inside of the mold, between mold sides and steel skin as it just forms. The carbon particles may react here with the skin right where still quite thin, and that in turn may result in local defects in the skin such as pores.

DESCRIPTION OF THE INVENTION

It is an object of the present invention to improve continuous casting of steel by the use of a casting powder which is free from uncombined carbon which is to be placed onto the surface level of a bath of molten steel and remains loose and heat insulating, just until melting, to protect the steel underneath from oxydation and heat radiation emission.

In accordance with the preferred embodiment of the invention it is suggested to provide a conventional casting powder (though certain preferred compositions will be given below) and to provide for specific additives to that casting powder which decompose completely at a temperature of 600° C. or below (at atmospheric pressure) under formation of gas. In other words, these additives to the powder are to undergo a chemical reaction so that at the temperature of the powder cover on the molten steel the resulting decompositioning products are gaseous and volatile accordingly. Specifically, the additives are to have a specific gassing constant $f$ larger or equal to 0.5 wherein $f$ is defined by cubic meter developed gas per kilogram gas generating substance prior to the gas generation. This constant $f$ can also be defined by $n.22.4$ per mole-kilogram gas generating substance, with $n$ being the number of gas moles that result from the reaction or decomposition of a mole kilogram substance.

The following table shows several materials which meet this criterium. Generally, these additive materials give off $CO_2$ or contain nitrites Table 1

| Substance | Reaction & Decompositioning Temperature at 1 Atmosphere Pressure | Moles of Gas (n) | f |
|---|---|---|---|
| a) $NH_4 . (CO_2NH_2)$ | 100–200 | 3 | 0.87 |
| b) $(NH_4)_2 . CO_3$ | 100–300 | 4 | 0.94 |
| c) $NH_4 . NO_2$ | 100–300 | 3 | 1.05 |

Substance (a) undergoes the following reaction $NH_4{\cdot}(CO_2NH_2) \rightarrow 2HN_3 + CO_2$ which are indeed three moles of gas Substance (b) undergoes the following reaction $(NH_4)_2{\cdot}CO_3 \rightarrow 2NH_3 + H_2O + CO_2$, or four moles of gas Substance (c) undergoes the following reaction $NH_4{\cdot}NO_2 \rightarrow 2H_2O + N_2$ or three moles of gas Another useable substance is $NH_4NO_3$ which is strongly exothermic and has a specific gassing constant $f = 0.84$ and a decompositioning heat of 347 kilocalories per kilogram which is about $28{\cdot}10^3$ kilocalories per kilomole. Such a compound should be diluted or used at a small percentage; also careful handling is advisable.

It is within the scope of the invention to use further additives which either themselves or their decompositioning products react with other additives in a catalytic reaction for the development of gas. Take for example iron carbonyl, $Fe_2(CO)_9$ or $Fe_3(CO)_{12}$; they decompose already at 100° and 140° C. respectively and have specific passing constants of $f = 0.56$ and $f = 0.54$ respectively. As these materials decompose the iron thus produced is present in finely divided form and with a large effective surface. That iron serves readily as a catalyst for example, for decomposing ammonia which resulted from the decompositioning of ammonium carbonate.

The additives envisioned here are added to carbon free casting powder of conventional composition at a range of 0.5 to 10% (by weight) additive. For catalytically effective additives 0.1 to 10% by weight suffice.

It should be noted, that the additives considered here develop less gas than a comparable quantity of carbon. That disadvantage, however, is more than offset by the much lower temperature of decompositioning and by the fact that, unlike carbon, these additives decompose almost without leaving any trace of a residue. Additives acting as catalyst may also act as gas developers and any residue here does not influence the steel or the casting powder layer in any detrimental fashion.

The casting powder to be used can be conventional; however, the following three were found particularly suitable (all percentages by weight) whereby additive b) has been used in the first two.

Table 2

| | | | | | | | |
|---|---|---|---|---|---|---|---|
| 1) | $SiO_2$ | CaO | $Al_2O_3$ | $Fe_2O_3$ | $CaF_2$ | $(NH_4)_2CO_3$(=b) | |
| | 44 | 41 | 6 | 2 | 4 | 3 | |
| 2) | blast furnace slag | | $CaCO_3$ | Perlite | $SiO_2$ (Sand) | $CaF_2$ | (b) |
| | 64 | | 5 | 10 | 10 | 8 | 3 |
| 3) | Slag | Soda | Perlite | $SiO_2$ | $CaF_2$ | $(NH_4)_2NO_3$ | |
| | 33 | 18 | 7 | 10 | 30 | 2 | |

The ground blast furnace slag in powders (2) and (3) had a content of

| SiO | CaO | MgO | $Hl_2O_3$ | $Fe_2O_3$ |
|---|---|---|---|---|
| 40 | 32 | 4 | 9 | 2 |

the remainder being the usual MnO, $Na_2O$, $K_2O$. Powder of the type (1) must be regarded as preferred particularly because the oxides $SiO_2$ and CaO are being used as the main constituents and the latter is present as caustic lime.

The specific gassing constant $f$ shall be explained by way of a specific example. Take additive (c) in the table 1 above, i.e., $NH_4 \cdot NO_2$. As that ammonium nitrite is heated it decomposes into water vapor and nitrogen under the following reaction $$NH_4 \cdot NO_2 \rightarrow 2H_2O + N_2.$$

Since each molecule additive substance decomposes into three molecules, a mole kilogram of that substance will result in three moles of gas or $3 \times 22.4$ cubic meters.

The molecular weight of ammonium nitrite is 64 kilograms and one mole (un-decomposed substance) will occupy 22.4 cubic meters. On the basis of the reaction equation one can see that three mole-volumes are produced ($n = 3$), i.e. the 64 kilograms ammonium nitrite when decomposed result in $3 \times 22.4$ cubic meters gas. Therefore, $f = 67.2\ m^3/64K_g = 1.05$ cubic meters per kilogram gas generating material.

The invention is not limited to the embodiments described above but all changes and modifications thereof not constituting departures from the spirit and scope of the invention are intended to be included.

We claim:

1. In a method of continuous casting of steel, the use of a casting powder for application to the molten steel, the powder being free from uncombined carbon but including carbonates or nitrites as additives which decompose completely at a temperature of not more than 600° C. under atmospheric pressure under development of gas pursuant to the decompositioning, for generating a gas barrier against the influx of oxygen into the steel.

2. Method as in claim 1, using a powder, wherein the additives have a specific gas generation constant in ecxess of 0.5 defined as cubic meter developed gas per mole kilogram gas generating substance.

3. Method as in claim 1 wherein the additives used include $NH_4 \cdot (CO_2NH_2)$.

4. Method as in claim 1, wherein the additives used include ammonium nitrites.

5. Method as in claim 1, wherein at least one additive act as a catalyst which provides for catalytic decompositioning of the additive which releases gas upon decompositioning.

6. Method as in claim 5, wherein the catalyst is itself a gas generator.

7. Method as in claim 5, wherein 0.1 to 10% of the powder is such a catalyst.

8. Method as in claim 2, wherein the additives used are 0.5 to 10% by weight of the total casting powder composition.

9. Method as in claim 1, wherein the additives used include $(NH_4)_2\ CO_3$.

10. Method as in claim 1, wherein the additives used include ironcarbonyl.

* * * * *